United States Patent [19]

Lamb

[11] 4,313,991

[45] Feb. 2, 1982

[54] SEAM-COVERING DEVICE

[76] Inventor: Thomas R. Lamb, 3 Dennison Ave., Freeport, Me. 04032

[21] Appl. No.: 136,170

[22] Filed: Mar. 31, 1980

[51] Int. Cl.[3] ..... B32B 3/02; B32B 3/10

[52] U.S. Cl. ..... 428/131; 428/61; 428/167; 428/174; 428/192; 428/332; 428/343; 428/906

[58] Field of Search ..... 428/167, 174, 131, 61, 428/906, 343, 57, 192, 332; 156/45, 71, 304.3, 304.4; 52/459, 460, 461, 417

[56] References Cited

U.S. PATENT DOCUMENTS 4,042,739 8/1977 Emal ..... 428/156

4,135,023 1/1979 Lloyd et al. ..... 428/343

4,157,271 6/1979 Moore ..... 52/417

*Primary Examiner*—Paul J. Thibodeau

*Attorney, Agent, or Firm*—William Nitkin

[57] ABSTRACT

A plasterboard seam taping strip having a body formed of planar plastic material with tapered side edges. The rear of the body strip has self-adhesive material applied thereto. On the face of the body strip, extending lengthwise in the middle thereof is a central projection. In alternate embodiments the central projection may be elongated in width and have a notch defined therein. The seam-taping member of this invention may be applied to seams on walls and also on inside and outside corners.

7 Claims, 8 Drawing Figures

SEAM-COVERING DEVICE

BACKGROUND OF THE INVENTION

1. Field of the Invention

The device of this invention is utilized for covering seams between plasterboard members to form, when covered by plaster, an invisible joint therebetween.

2. History of the Prior Art

At present in plasterboard construction where plasterboard sheets meet, the seams are often covered with a paper tape approximately 3 inches in width which is plastered over so as to become invisible under the final painting or papering of the wall. Corner seams, both inside and outside, have most recently been finished using metal stripping in special shapes, one of which forms the inside corner and another which forms the outside corner.

SUMMARY OF THE INVENTION

It is an object of this invention to provide a plastic material for seam covering which can be easily applied, be provided in rolls of any length, and which can alternately be used for flat seams on walls as well as for seams on the inside and outside corners in the various embodiments thereof.

It is a further object of this invention to provide a seam-covering strip which will make it easy for the plasterer to apply the plaster in perfect registration with the wall for minimum visibility of the finished seam.

In the invention's basic embodiment a plastic body strip is provided having tapered edges on each side approximately 3 inches in width. The rear of the plastic body strip is provided with an adhesive back for easy and quick affixation over the plasterboard's seam. Provided along the central front portion of the body strip is a central projection which may, in one embodiment, form a bead-like projection which rises above the body strip approximately ⅛ inch. Plaster is then positioned with a trowel or other tool on either side of the bead. The bead causes the trowel to operate at an angle to the plasterboard to form a perfectly feathered edge. The same body strip may have a widened central projection with a notch cut out at approximately 90° on its front face. This strip may be used on flat surfaces with the notch being filled in by the plaster. However, this embodiment can also be utilized for both inside and outside corners. The strip may be folded thereby closing the notch to form an inside corner with the remainder of the central projection forming a rise acting like the bead in the initially discussed embodiment to cause the feathering of the plaster. This strip also can be used on outside corners with the same central projection forming the feathering causing rises on either side of the point of the corner. The inner part of the 90° notch cut out is spread flat at the point of the corner a width of approximately ⅛ inch. This invention will make it much easier to form outer and inner corners without the necessity of having many different types of metallic inside and outside corner-forming members which must now be tacked in position.

An alternate embodiment of the seam-covering strip has an approximate 90° rear-notched projection which when utilized on an outside seam forms a right-angled corner while the notch is closed with the rest of the projection forming the feathering causing rise for the plaster. The rear-notched member can be utilized for an inside corner with the notch opened and although it leaves a small space between the plasterboard and the strip, the plaster will form into a feathered edge by the projections being positioned half on each side of the corner.

The seam strip of this invention can be provided in roll form in any length. It should be made of pliable plastic material but one which will not have memory of its roll form but of its linear form so that when placed on a wall, it would not have a tendency to curl. Further the outside edges should be somewhat tapered toward the plasterboard so as not to form a sharp corner that might protrude through the thin portion of the plaster being feathered thereover. It should be noted that it would be of significant advantage to individuals or professionals when plastering walls to have a material thich can be used as described herein for all inner and outer corner seams and wall seams rather than having different materials for each use.

DESCRIPTION OF THE PREFERRED EMBODIMENT(S)

Figure 1:
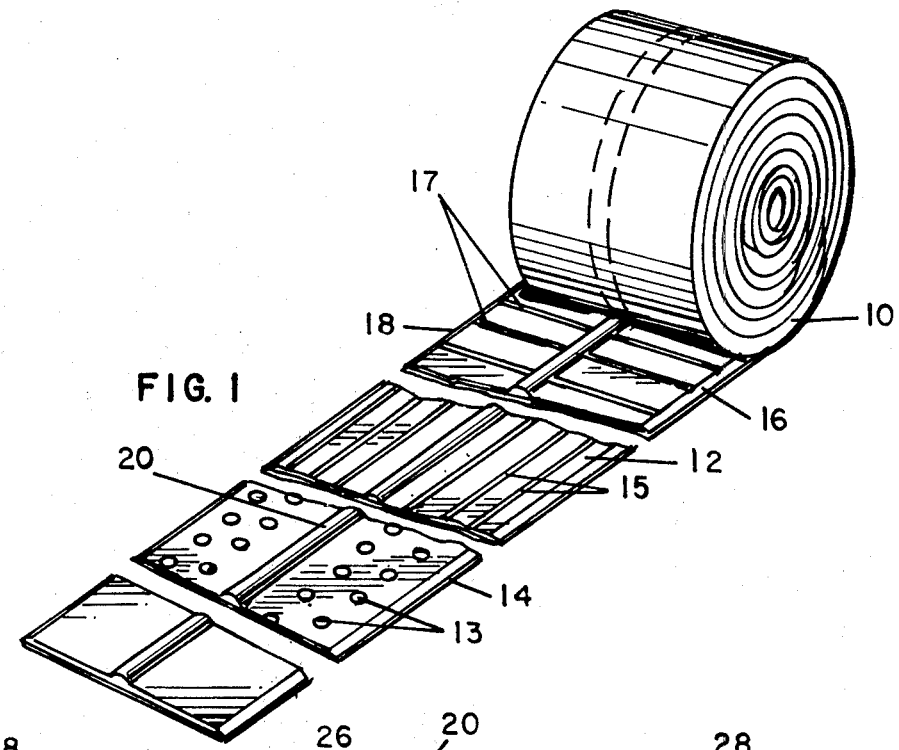
FIG. 1 is a view of a strip of seam-covering tape of this invention in roll form.

FIG. 1 illustrates roll 10 of plastic strip material 12 having an adhesive back 14 and tapered edges 16 and 18. On the front face of strip 12 is central projection 20. This central projection as seen in this embodiment is bead-like and may be approximately ⅛ inch in height. Other shapes can be utilized for this central projection if desired, the idea being to cause the trowel to be elevated at a central point causing the plaster to be automatically feathered to the plasterboard surface beyond the tapered edges of strip 12. In use it would be expected that the adhesive back would be paper covered which paper would be peeled back and removed before application.

Figure 2:
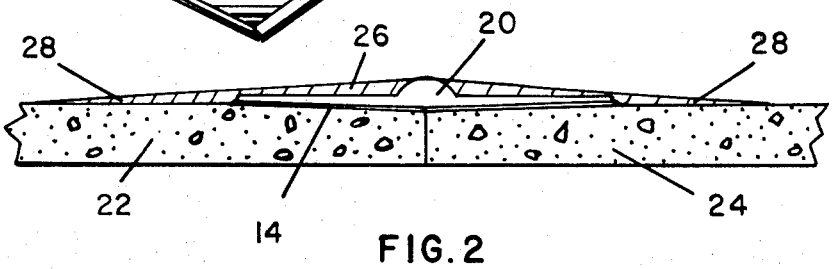
FIG. 2 is a cross-sectional view through a section of the seam strip showing the central bead and plaster placed thereover.
Figure 3:
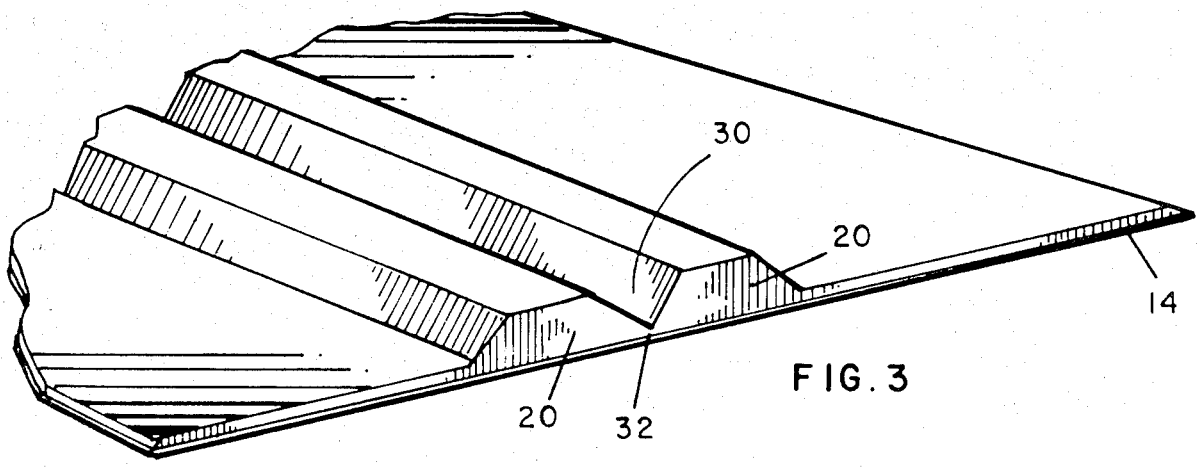
FIG. 3 is an illustration of a seam strip with a front-notched projection.
Figure 4:
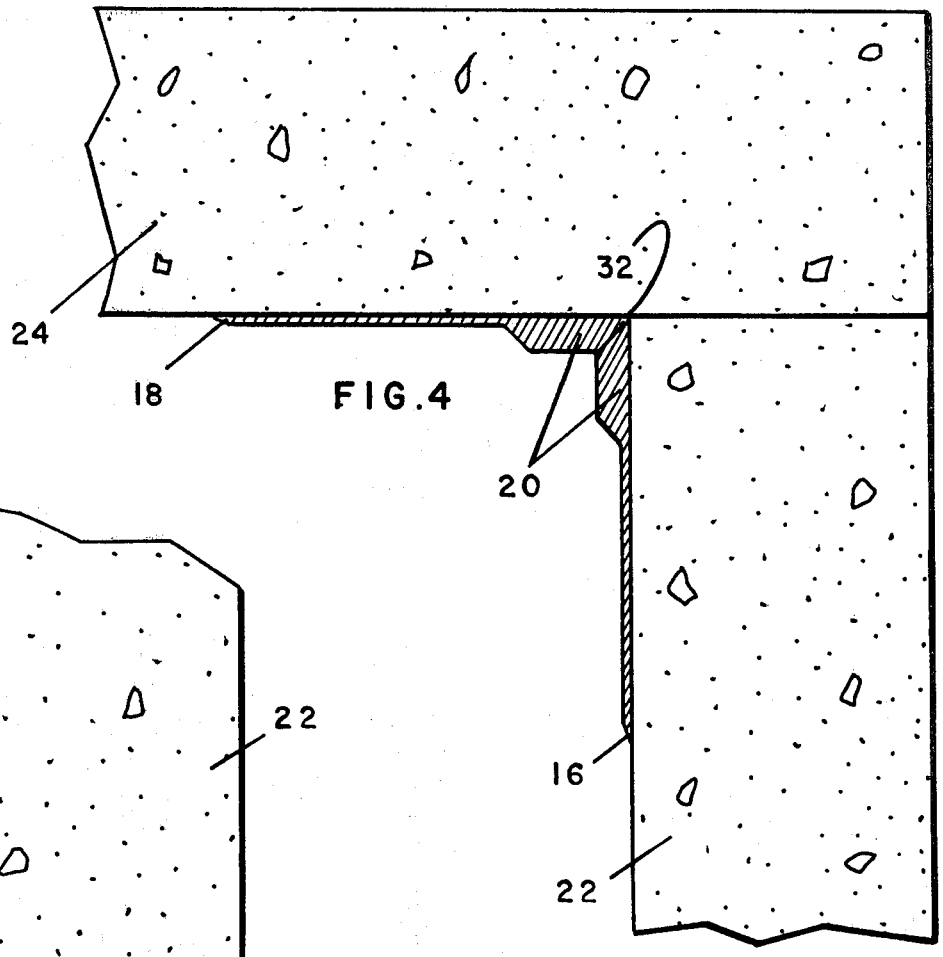
FIG. 4 shows the strip of FIG. 3 mounted on an inside corner.
Figure 5:
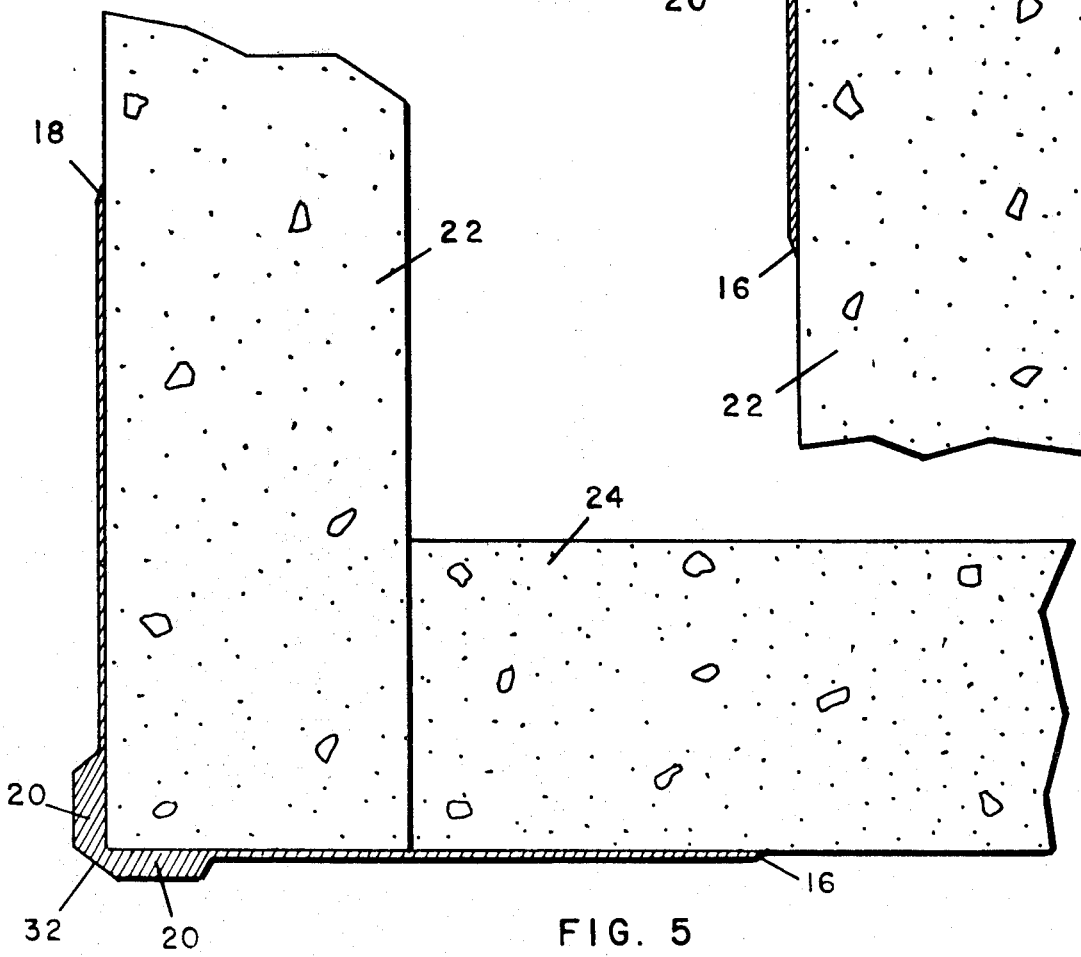
FIG. 5 illustrates the strip of FIG. 3 mounted on an outside corner.

Seen in FIG. 2 is the junction of plasterboards 22 and 24 and the affixation over the junction of strip 12 held to the plasterboard by adhesive 14. The bead-like central projection 20 is seen with plaster 26 extending from either side thereof and feathered out toward edges 28 to the plasterboards. An alternate embodiment which can be utilized not only for wall seams but also for inner and outer corner seams is seen in FIG. 3 wherein the bead-like projection 20 is widened along the length of the strip and has a front-faced notch 30 of approximately 90° cut out therefrom. This design allows the strip to be folded along the central portion 32 to accommodate either an inner or outer corner. By folding the edges backwards, one may use the strip on an outer corner as seen in FIG. 5. This utilization will create a flat surface where the notch was and an elevated portion of the central projection above the strip which will cause the plaster to be feathered when applied. The angular notch will open to form the edge of the wall and form a neat and attractive edge. If the edges of the strip are moved forward toward one another, the notch closes in on itself, and the strip may be positioned in an inside corner as seen in FIG. 4. The plaster may be applied in the same fashion with the trowel rising on the elevated edge of the central projection with the plaster extending beyond the edge of the strip automatically being feathered by the trowel at the angle created by the elevated sections of the central projection. The edges of the central projection may be tapered toward the body strip to avoid any sharp corners protruding through the plaster.

Figure 6:
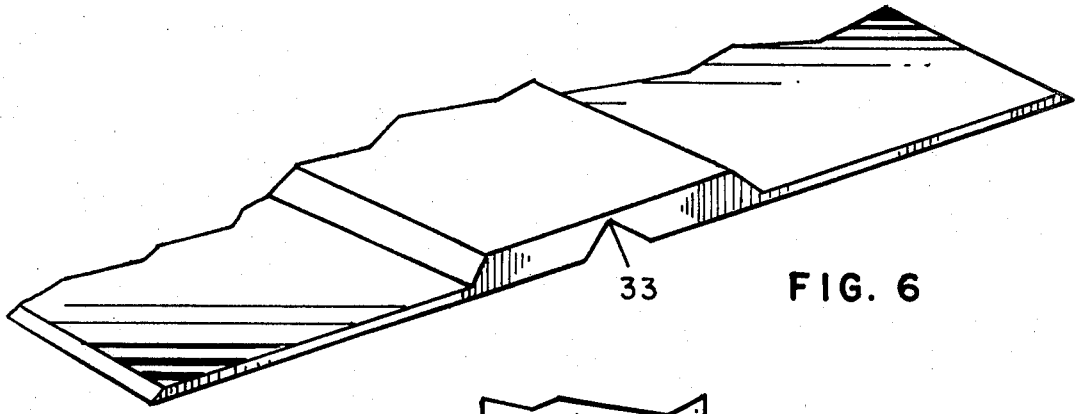
FIG. 6 shows a cross-sectional view through a strip with a rear-notched central projection.
Figure 7:
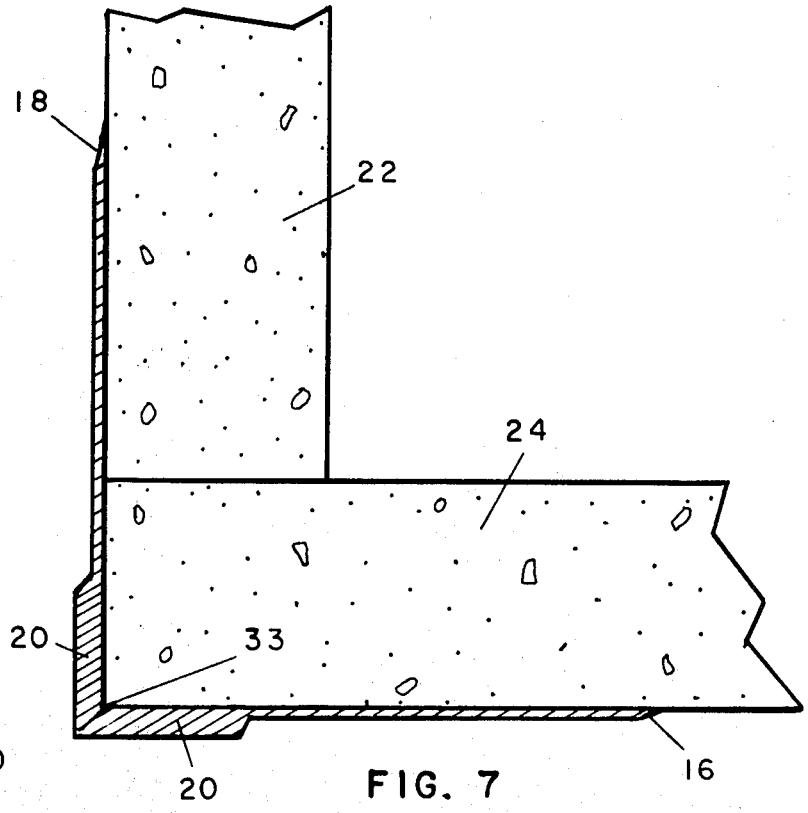
FIG. 7 shows the strip of FIG. 6 positioned on an outside corner.
Figure 8:
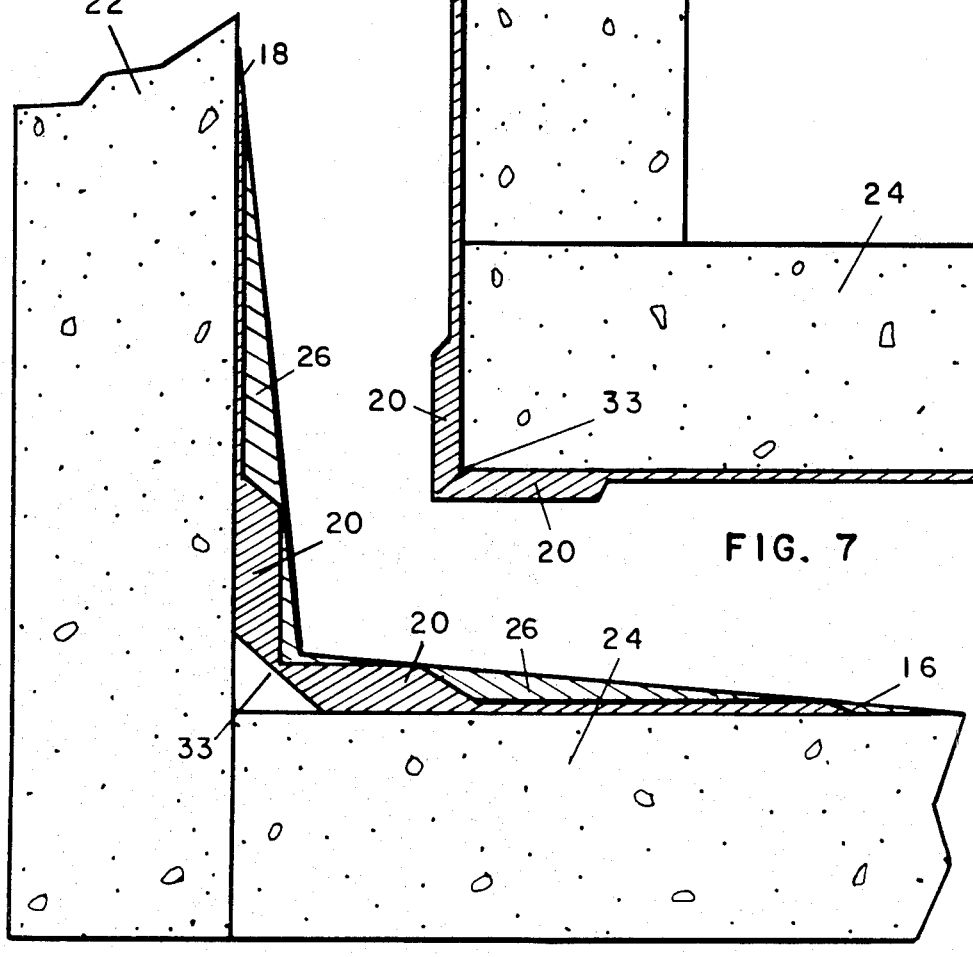
FIG. 8 illustrates the strip of FIG. 6 positioned on an inside corner.

In an alternate embodiment a similar strip may have a rearnotched central projection as seen in FIG. 6. This strip will produce, when placed on an outer corner with insides of the rear 90° notch coming together, a sharp outside corner as seen in FIG. 7. The plaster may be beaded from the edge of the central projection on each side of the corner and feathered against the plasterboard beyond the strip. When this embodiment is utilized on an inside corner as seen in FIG. 8 a small space is created between it and the corner, but the plaster may still be positioned over the projections to be feathered to the plasterboard.

Various embodiments of plastic strip 12 can be provided as further illustrated in FIG. 1 in sectional views. In order to assist adhesion of the plaster to the strip, the strip can be provided with a matte or non-smooth surface. The strip can also be provided with holes 13, longitudinal grooves 15, or horizontal grooves 17 which will assist in holding the plaster to the strip. In some embodiments the plaster can run up to a projection 20 as in FIG. 5 and projection 20 would then not be plastered over but merely painted over. Further plastic strip 12 can be made of formed paper to the desired shape or of other materials suitable to accomplish the desired result.

This invention will significantly reduce the amount of time now taken to finish a wall joint. Although the present invention has been described with reference to particular embodiments, it will be apparent to those skilled in the art that variations and modifications can be substituted therefor without departing from the principles and spirit of the invention.

I claim:

1. An improved plasterboard seam taping member for use at junctions between adjoining pieces of plasterboard where the plasterboard edges are slightly tapered comprising:

a body strip formed of planar plastic material having a front face, a rear face, and parallel side edges which have a taper toward said rear face;

adhesive means affixed to the rear of said body strip material to adhere said body strip to said plasterboard over the seams formed therebetween; and a narrow projection approximately $\frac{1}{8}$ inch in height in the form of a bead having a top extending longitudinally parallel to said side edges upon the central portion of the front face of said strip, the top of said projection, when said body strip is adhered to the slightly tapered plasterboard edges at a junction between two sheets of plasterboard, being higher than said body strip elevating the trowel applying plaster to the joint and causing a feathering of the plaster outward from said projection to beyond the side edges of said body strip.

2. The structure of claim 1 wherein said central projection is widened and has defined therein a notch in its face, said strip being adapted to cover not only seams on planar surfaces but also to be bent for use on inside and outside corner seams and is adapted for portions of the widened central projection, once said strip is installed to be on each side of said corner, to elevate said trowel to cause a feathering of the plaster beyond said body strip.

3. The structure of claim 1 wherein said central projection is widened and has defined in the rear face of said strip a notch adapted to assist in the bending of said strip in either direction for application to either an inside or outside corner seam and is adapted for portions of the widened central projection, once said strip is installed to be on each side of said corner, to elevate said trowel to cause a feathering of the plaster beyond said body strip.

4. The structure of claim 2 wherein the sides of said notch are at 90° to one another.

5. The structure of claim 1 wherein said strip has a plurality of apertures defined therein.

6. The structure of claim 1 wherein said strip has a plurality of longitudinal grooves defined therein.

7. The structure of claim 1 wherein said strip has a plurality of horizontal grooves defined therein.

* * * * *